US006321049B1

(12) United States Patent
Endoh

(10) Patent No.: US 6,321,049 B1
(45) Date of Patent: Nov. 20, 2001

(54) METHOD AND APPARATUS FOR IMAGE FORMING CAPABLE OF EFFECTIVELY CLEANING A TRANSFER MECHANISM

(75) Inventor: Shuuichi Endoh, Kamakura (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/619,673

(22) Filed: Jul. 19, 2000

(30) Foreign Application Priority Data

Jul. 19, 1999 (JP) ..... 11-204769

(51) Int. Cl.[7] ..... G03G 21/00; G03G 15/22
(52) U.S. Cl. ..... 399/101; 399/128
(58) Field of Search ..... 399/98, 101, 127, 399/128, 129, 234, 235

(56) References Cited

U.S. PATENT DOCUMENTS

| | | | |
|---|---|---|---|
| 4,183,655 | | 1/1980 | Umahashi et al. . |
| 5,768,665 | * | 6/1998 | Yamanaka et al. ..... 399/235 |
| 5,822,649 | | 10/1998 | Karashima et al. . |
| 5,826,144 | * | 10/1998 | Takenaka et al. ..... 399/235 X |
| 6,025,109 | | 2/2000 | Karashima et al. . |

FOREIGN PATENT DOCUMENTS

| | | | |
|---|---|---|---|
| 4-120577 | | 4/1992 | (JP) . |
| 7-261627 | * | 10/1995 | (JP) . |
| 08-328401 | | 12/1996 | (JP) . |

* cited by examiner

*Primary Examiner*—Joan Pendegrass
(74) *Attorney, Agent, or Firm*—Oblon, Spivak, McClelland, Maier & Neustadt, P.C.

(57) ABSTRACT

An image forming apparatus including a photoconductive member, a charging member, a development mechanism, a transfer mechanism, and a power supply source. The development mechanism develops an image on the photoconductive member. The toner is normally charged with a voltage having a same polarity as the charge of the photoconductive member. The transfer mechanism includes a transfer roller to transfer the developed image from the photoconductive member onto a recording sheet. The power supply source supplies a voltage, having the same polarity as the voltage applied during a normal transfer operation, to the transfer roller when a region of the surface of the photoconductive member passes through a development region without a performance of a development operation and reaches a transfer region under a condition in which no recording sheet exists therebetween.

13 Claims, 8 Drawing Sheets

METHOD AND APPARATUS FOR IMAGE FORMING CAPABLE OF EFFECTIVELY CLEANING A TRANSFER MECHANISM

CROSS-REFERENCE TO RELATED APPLICATIONS

This application claims priority to Japanese patent application No. JPAP11-204769 filed on Jul. 19, 1999 in the Japanese Patent Office, the entire contents of which are hereby incorporated by reference.

BACKGROUND OF THE INVENTION

1. Field of the Invention

The present invention relates to a method and apparatus for image forming, and more particularly to a method and apparatus for image forming that is capable of reducing an unnecessary toner deposition onto a recording sheet.

2. Discussion of the Background

In image forming apparatuses such as copying machines, printers, facsimile machines, or the like using an electrophotographic method, a contact type development mechanism and a roller for image transferring have commonly been employed. It has accordingly been an important factor for an image forming apparatus to assure that an unnecessary toner deposition onto a recording sheet is avoided. As one exemplary technique, a cleaning method for cleaning a transfer member of an image forming apparatus is described in Japanese Laid-Open Patent Publication No. JPAP4-120577 (1992). The image forming apparatus described in this publication includes a contact type development mechanism and a transfer member including a foam roller and performs a cleaning operation for cleaning a transfer roller. In the cleaning operation, a development operation performed by a development roller is inhibited by applying a voltage to the development roller for a predetermined time period. In this process, the voltage has a reverse polarity relative to that of a voltage normally used. Then, a transfer roller is applied with a voltage having a reverse polarity relative to that of a voltage normally used during a normal transfer operation. In this case, a polarity of the applied voltage is same as that of a normal toner charge. Thus, the transfer roller charged with the same polarity of that of the toner deposited on the transfer roller and, therefore, the toner repels against the transfer roller. As a result, the toner is cleaned off the transfer roller.

There are some more known methods for cleaning the transfer roller. For example, in one method, the transfer roller is applied with a voltage having the same polarity of the toner's normal charge so that the toner deposition onto the transfer roller can be inhibited. In this case, the toner is the normal-charged toner developed in an outside of a recording sheet area or remaining on a photoconductive member due to a defective transportation of a recording sheet. Another exemplary method teaches a technique for pressing unnecessary toner deposited on the transfer roller back to the photoconductive member during the time before the deposited toner loses its charge.

In general, the transfer roller is prone to increase its resistance by the deposition of particles including the toner and dust. When the resistance is increased to a certain level, an electric field of a transfer region formed by the photoconductive member, the transfer sheet, and the transfer roller is drastically weakened. As a result, the transfer roller cannot attract the toner forming an image on the photoconductive member, thereby deteriorates its performance of the image transfer operation.

Since the transfer roller may not instantly cause wear and has relatively small variations of resistance over time, the life time of the transfer roller is mainly bound by the above-mentioned resistance increased by the particles of the toner and dust. Particularly, it is known the toner deposition is a greater factor. If a transfer roller is not exchangeable in an image forming apparatus, the shorter life time of the transfer roller is a critical problem for the user.

In recent years, the above-mentioned image forming apparatus including the contact type development mechanism and the transfer member including the foam roller or including the contact type charging mechanism, the contact type development mechanism and the transfer member including the foam roller has strongly been needed from the recent trends for a small size, a low cost, a maintenance-free machine, a small ozone emission, etc. On the other hand, this type of image forming apparatus involves a toner deposition problem with respect to the transfer roller. More specifically, in such an image forming apparatus, toner charged in a reverse-polarity exists besides the toner charged in a normal polarity. These reverse-charged toner particles are eventually transferred onto the transfer roller and accelerates the toner deposition.

In the development method causing the development roller to make contact with the photoconductive member, the toner receives a relatively great electrostatic potential in a relatively small gap formed between the photoconductive member and the nip area of the development roller and will receive charges from the photoconductive member and/or the development roller. Thereby, the charge of the toner will be unstable. This causes the reverse-charged toner.

In some cases, a blade made of metal or the like is used in the development mechanism to press the toner so as to cause friction against the toner and the toner is accordingly charged, as a result. Even in this case, it is possible that the toner will be reverse-charged.

Also, the reverse-charged toner will be produced when the development roller is subjected to a long time usage. In this case, the development roller is worn or has the deposition of small particles including toner materials and/or dust, which causes deterioration of the development function. In the deteriorating development operation, it is possible that some toner particles will be reverse-charged and they are transferred onto the photoconductive member.

Further, a combination of the contact type charging member and the contact type development has a factor to increase the reverse-charged toner. Specifically, in the process for the contact type charging member to provide a charge to the photoconductive member, the charge voltage of the photoconductive member is composed of great amplitudes from a micro-view. In the case of using the contact type development mechanism, the reverse-charged toner will easily be produced by a local part of such a great amplitude or at a higher part of the charge voltage of the photoconductive member.

The deposition of the reverse-charged toner easily occurs during the normal image forming operation, the time when the photoconductive member is rotated in the interval between the recording sheets, in the machine warm-up time, in the machine cool-down time, and so on. When the transfer roller makes contact with the photoconductive member, the toner is transferred onto the transfer roller. This causes the next recording sheet to become dirty. In some cases, even a backup roller in the following fixing mechanism will be made dirty. When the toner is undesirably conveyed by the rear surface of the recording sheet onto the backup roller of the fixing mechanism, a serious problem may occur. For example, the recording sheet may be pulled into the mechanism.

Therefore, the above-mentioned image forming apparatus including the contact type development mechanism and the transfer member including the foam roller or including the contact type charging mechanism, the contact type development mechanism and the transfer member including the foam roller is needed for a countermeasure for protecting the reverse-charge toner deposition, which is not solved by the above-mentioned Japanese Laid-Open Patent Publication No. JPAP4-120577 (1992).

In addition, the development roller may possibly be reverse-charged during the charging operation relative to the photoconductive member. In this case, a greater amount of the reverse-charged toner will be produced and deposited onto the photoconductive member. Therefore, performing the cleaning operation relative to the transfer roller under such a circumstance may not be effective.

SUMMARY OF THE INVENTION

The present invention provides a novel image forming apparatus. In one example, a novel image forming apparatus includes a photoconductive member, a charging member, a development mechanism, a transfer mechanism, and a power supply source. The charging member is configured to charge the photoconductive member. The development mechanism is configured to make contact with the photoconductive member to transfer toner thereto so as to develop an image on the photoconductive member. In a normal charged condition, the above-mentioned toner has a polarity same as a polarity of a charge of the photoconductive member. The transfer mechanism includes a transfer roller which is configured to make contact with the photoconductive member to transfer the image developed by the development mechanism from the photoconductive member onto a recording sheet. The power supply source is configured to supply a first voltage to the transfer roller when a region of the surface of the photoconductive member charged by the charging member passes through a development region at which the photoconductive member and the development mechanism make contact with each other without having a performance of a development operation performed by the development mechanism and reaches a transfer region at which the photoconductive member and the transfer roller make contact with each other under a condition in which no recording sheet exists therebetween. The above-mentioned first voltage has a polarity same as a polarity of a second voltage applied to the transfer roller during a normal transfer operation.

The power supply source may be either one of constant-voltage and -current power supply sources.

The first voltage may equal to the second voltage.

The charging member may include a contact member configured to make contact with the photoconductive member to charge the surface of the photoconductive member.

The photoconductive member may be exposed to light for a time period in which the photoconductive member moves for one rotation or more to reduce a voltage of an entire surface thereof after the photoconductive member is charged by the charging member but before an image is output and an image forming operation is ended. Further, the development mechanism may be applied with a voltage having a reverse-polarity relative to a voltage applied to the development mechanism during a normal development operation when a region of the surface of the photoconductive member having the reduced voltage reaches the development region. Further, the power supply source may be caused to apply to the transfer roller for a predetermined time period a voltage having a same-polarity relative to a voltage applied to the toner during the normal development operation when the region of the surface of the photoconductive member having the reduced voltage reaches the transfer region. Further, the transfer roller may be grounded for a predetermined time period.

Further, the present invention provides a novel method of image forming. In one embodiment, a novel method includes the steps of charging, exposing, first causing, and second causing. The charging step charges a surface of a photoconductive member. The exposing step exposes the surface of the photoconductive member in accordance with image information. The first causing step causes a development roller to develop an image on the surface of the photoconductive member using toner which is in a normal charged condition having a same polarity as a polarity of a charge applied to the photoconductive member. The second causing step causes a transfer roller to transfer the image developed by the developing step from the photoconductive member onto a recording sheet with an application of a first voltage from a power supply source. This method further includes the third causing step for causing the power supply source to supply a second voltage to the transfer roller when a region of the surface of the photoconductive member charged by the charging step passes through a development region without having a performance of a development operation performed by the developing step and reaches a transfer region under a condition in which no recording sheet exists in the transfer region. The above-mentioned second voltage has a same polarity as a polarity of the first voltage.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
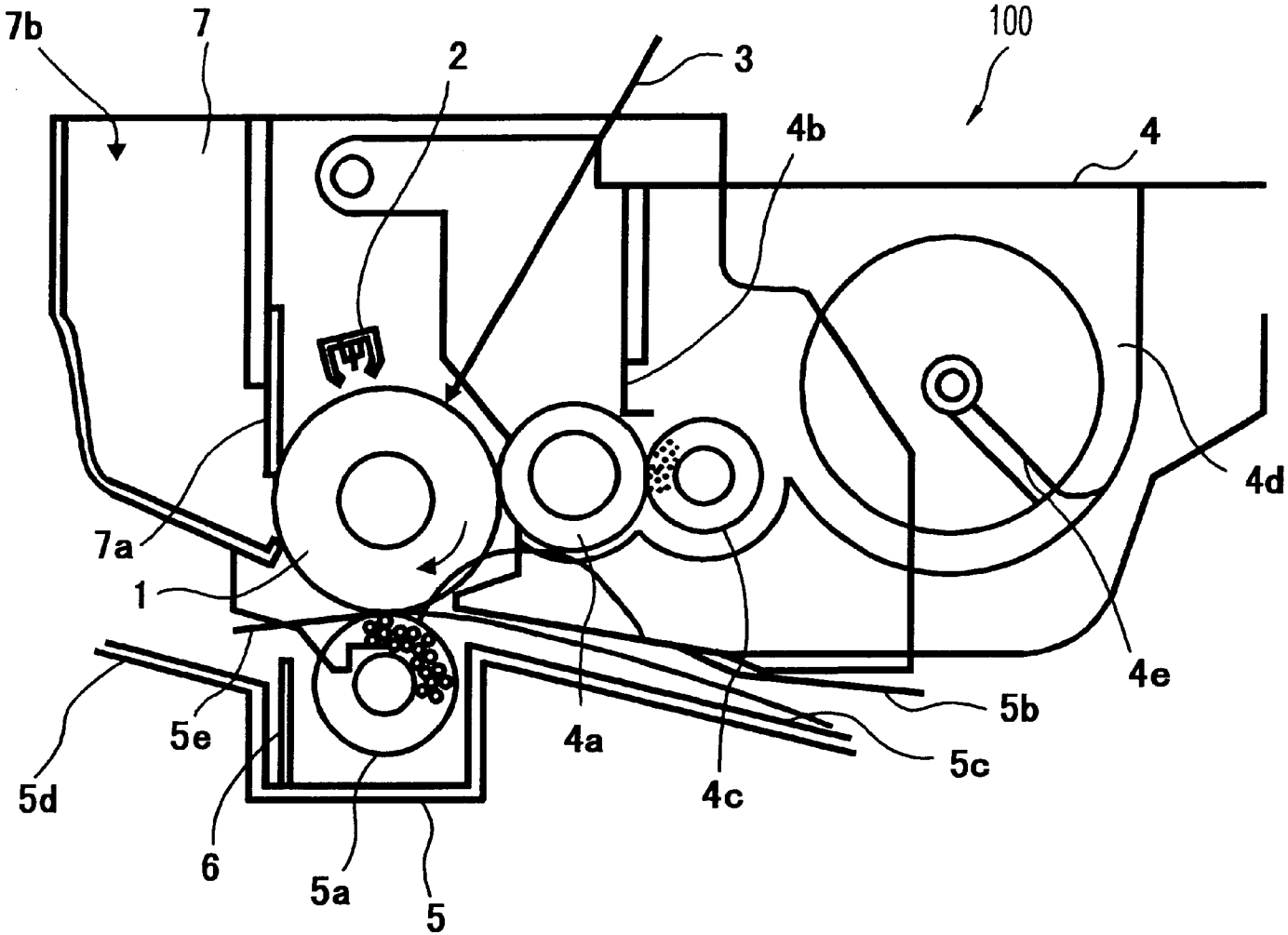
FIG. 1 is a side sectional view of an image forming apparatus according to a first embodiment of the present invention.

In describing preferred embodiments illustrated in the drawings, specific terminology is employed for the sake of clarity. However, the invention is not intended to be limited to the specific terminology so selected and it is to be understood that each specific element includes all technical equivalents which operate in a similar manner.

Referring now to the drawings, wherein like reference numerals designate identical or corresponding parts throughout the several views, more particularly to FIG. 1, there is illustrated an image forming apparatus 100 according to a first embodiment of the present invention. As illustrated in FIG. 1, the image forming apparatus 100 includes a photoconductive member 1 approximately in the center thereof. The image forming apparatus 100 further includes a main charger 2, a laser light path 3, a development unit 4, a transfer unit 5, a quenching member 6, and a cleaning unit 7, arranged around the periphery of the photoconductive member 1 in the clockwise direction in the drawing.

The photoconductive member 1 has a drum shape but may have a belt-like shape. The main charger 2 includes a needle-like shaped electrode (not shown) and is arranged above the photoconductive member 1. The laser light path 3 is arranged downstream from the main charger 2 to conduct laser light emitted from a laser light generating unit (not shown) to the surface of the photoconductive member 1, as indicated by an arrow. The laser light conducted along the laser light path 3 writes an electrostatic latent image on the charged surface of the photoconductive member 1. The development unit 4 is arranged downstream from the laser light path 3 and includes a development roller 4*a* configured to make contact with the photoconductive member 1 to supply toner particles thereto so as to visualize the latent image formed on the surface thereof.

The transfer unit 5 is arranged downstream from the development unit 4 and includes a transfer roller 5*a* made of conductive foam and arranged in contact with the photoconductive member 1. The transfer roller 5*a* is rotated so as to convey a recording sheet 5*e*, pressed by the rotating photoconductive member 1 and the rotating transfer roller 5*a*, and electrically attracts the toner particles of the toner image so as to transfer the toner image from the photoconductive member 1 to the recording sheet 5*e*. The transfer unit 5 further includes an inlet upper guide 5*b*, an inlet lower guide 5*c*, and an outlet lower guide 5*d*, which form a paper path for guiding the recording sheet 5*e*.

The quenching member 6 is arranged downstream from the transfer roller 5*a* and diselectrifies the surface of the recording sheet 5*e* in contact with the transfer roller 5*a* so that the recording sheet 5*e* is more likely to separate from the photoconductive member 1. The cleaning unit 7 is arranged downstream from the quenching member 6 and includes a cleaning blade 7*a* for scraping the remaining toner particles off the surface of the photoconductive member 1 and a cleaning toner tank 7*b* for collecting and storing the scraped toner.

The main charger 2 applies a relatively high voltage to the needle-like shaped electrode to cause a corona discharge such that the photoconductive member 1 is evenly subjected to and is charged with the corona discharge at the surface thereof. It is preferable that the photoconductive member 1 is charged to a desired charge level at each part of the surface thereof. As an alternative to the needle-like shaped electrode, the main charger 2 may include a wire electrode which will evenly charge the photoconductive member 1 by a similar action as the needle-like shaped electrode does. In general, the wire electrode has an advantage in performing the even charge but has a disadvantage in producing toxic gases such as ozone and nitrogen oxides. On the contrary, the needle-like shaped electrode has a disadvantage in performing the even charge but has a advantage in producing less toxic gases such as ozone and nitrogen oxides.

The laser light is generally produced by a laser diode or a specific gas and runs along the laser light path 3 until it reaches the surface of the photoconductive member 1. When the laser light scans the rotating photoconductive member 1, the charge of the photoconductive member 1 is changed in accordance with a signal of the laser light. Accordingly, a potential pattern, or an electrostatic latent image, is formed on the surface of the photoconductive member 1. As an alternative to the above-described laser light system using the laser diode, an LED (light-emitting diode) system may be used.

The development unit 4 uses a contact type development method and includes the above-mentioned development roller 4*a*, a development blade 4*b*, a toner supply roller 4*c*, a toner hopper 4*d*, and a toner transporting member 4*e*. The development roller 4*a* supplies toner to the photoconductive member 1, as described above. The development blade 4*b* regulates an amount of toner conveyed by the development roller 4*a* and finally charges the toner. The toner supply roller 4*c* preliminarily charges toner and supplies it to the development roller 4*a*. The toner hopper 4*d* contains the toner to protect it from scattering around the mechanism. The toner transporting member 4*e* transports the toner from the toner hopper 4*d* to the toner supply roller 4*c*.

As an alternative to the development roller 4*a*, a belt-shaped development member may be used. Further, a rotary roller may be used as an alternative to the development blade 4*b*. Further, a magnetized development roller may be used in place of the development roller 4*a* in the case when toner includes a magnetic substance. In this case, the toner supply roller 4*c* may be eliminated. Further, a configuration employing an intermediate toner supply member may also be used. In this case, a roller conveys a regulated layer of magnetized toner with a toner blade and transfers it to an intermediate supply member, i.e., a low hardness roller or belt, which makes contact with the photoconductive member. Then, the toner is supplied to the photoconductive member.

The development roller 4*a* is needed to softly make contact with the photoconductive member 1. Therefore, in many cases, the development roller 4*a* is basically made of rubber material. Typically, a polyurethane, a silicon, an EPDM, an NBR (acrylonitrile butadiene rubber), a hydric rubber, a fluorine rubber, or the like is used to form a certain thickness around a metal core. In many cases, the surface of the rubber roller is coated with a plurality of layers of a coating material for various purposes such as to facilitate charging toner by friction, smoothing the surface, preventing a toner sticking to the surface, reducing unevenness of resistance in the surface. The coating material may be a urethane resin, a polyamide resin, a silicon resin, or a fluorine resin depending upon the kinds of rubber material and the toner.

Although there is a difference in performance between the single-layered and multi-layered rollers, the single-layered roller can sufficiently be used as a development roller. In many cases, an area from the metal core to the surface of the development roller 4*a* is needed to be a semi-resistant area and a resistance in this area is usually set to a value between $10^4$ Ω and $10^{12}$ Ω. Smaller the variations of this resistance inside the roller and with time, better the performance in development. From this aspect, various improvements have been provided from the manufacturing points of view which, however, are omitted to be described here.

The development blade 4*b* is configured with a metal spring plate, a plastic spring plate, or a complex structure such as a spring metal plate stuck with a plastic, a spring plastic plate stuck with a metal, a spring plastic plate stuck with a different plastic, or the like. Also, the development blade 4*b* is configured to make contact in an even pressure with the development roller 4*a* in the axis direction of the development roller 4*a*. The purposes for this are to evenly give a charge to the toner passing through the contact point between the development roller 4*a* and the development blade 4*b* and to give an even density of toner to the surface of the development roller 4*a*. When the development roller 4*a* is made of conductive material such as a metal plate, in many cases, an external power supply source is used to apply a voltage to toner so as to increase an amount of charge of the toner and to stabilize the conditions of the toner. The development blade 4*b* has an L-like shape, as illustrated in FIG. 1, but may be formed in a straight shape as an alternative. In addition, a thick plate member supported by a spring member (i.e., a coil spring, a plate spring, or the like) to make contact in pressure with the development roller 4*a* may also be used as an alternative to the development roller 4*a* of FIG. 1.

The toner supply roller 4*c* is made of a foamed-rubber or a resin in a cylindrical form with a metal core inside. In the case of the toner supply roller 4*c*, an area from the metal core to the surface preferably is semi-conductive which is generally set to a resistance value between $10^3$ Ω and $10^9$ Ω. Further, the toner supply roller 4*c* needs to have an even inside hardness so as not to give variations of pressure to the development roller 4*a* when supplying with pressure the toner to the development roller 4*a* and giving a preliminary charge to the toner. The toner supply roller 4*c* is made of polyurethane, silicon, EPDM, polycarbonate, or the like.

Figure 2:
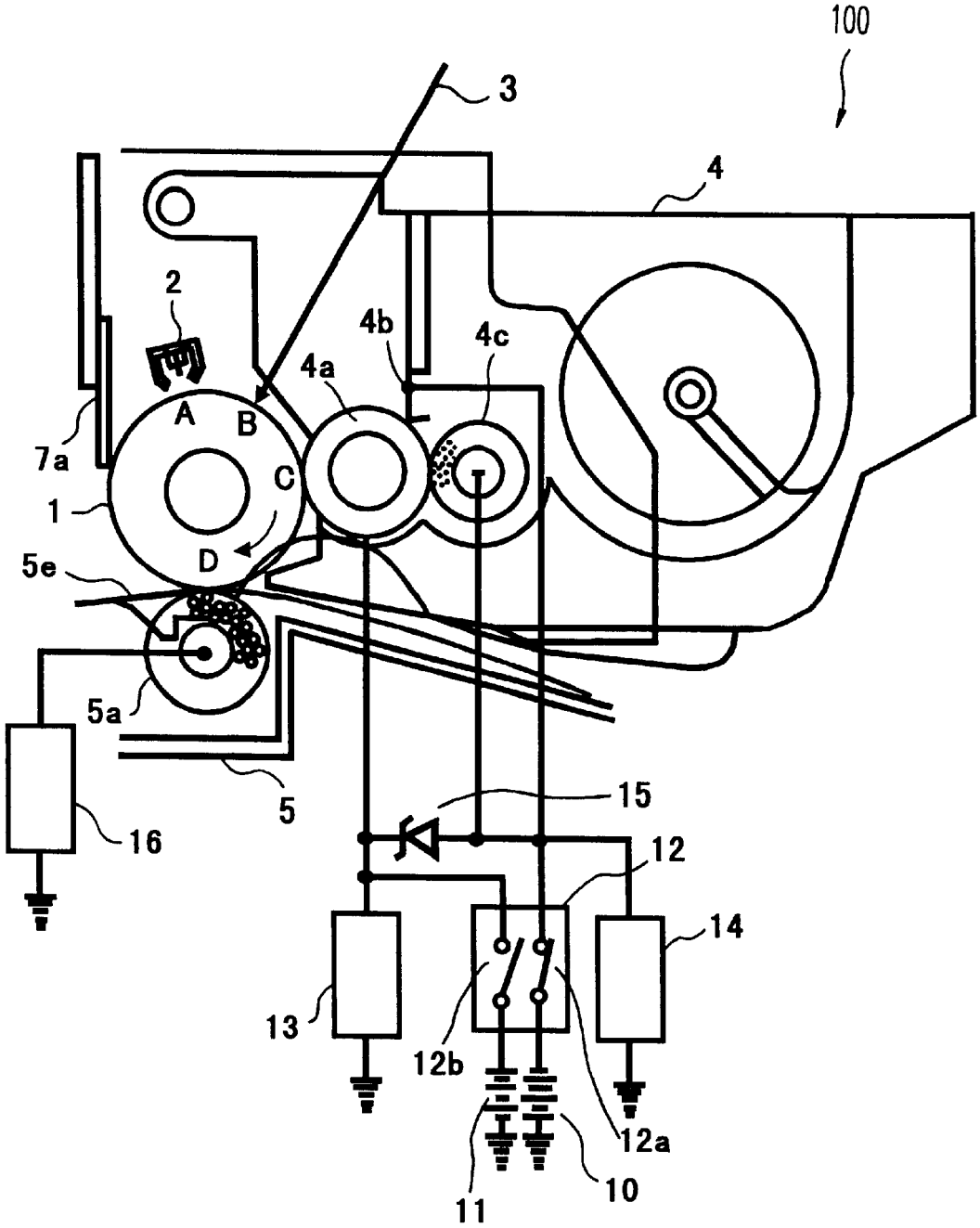
FIG. 2 is a schematic diagram showing a power supply system of the image forming apparatus of FIG. 1.

Referring to FIG. 2, a power system of the image forming apparatus 100 is explained. As illustrated in FIG. 2, the image forming apparatus 100 includes minus and plus development power sources 10 and 11, a power switch 12, high power application units 13 and 14, a constant-voltage power supply device 15 (i.e., a zener diode), and another high power application unit 16 (i.e., a constant-voltage or constant-current power application unit). The power switch 12 includes an internal switch 12*a* for switching to the power source 10 and an internal switch 12*b* for switching to the power source 11.

The constant-voltage power supply device 15 has one end connected to the development roller 4*a* and the other end connected to the toner supply roller 4*c*. The high power application unit 13 has one end connected to the development roller 4*a* and the constant-voltage power supply device 15 and the other end connected to the ground. The high power application unit 14 has one end connected to the toner supply roller 4*c* and the constant-voltage power supply device 15 and the other end connected to the ground. The minus development power source 10 has one end connected to the toner supply roller 4*c* and the constant-voltage power supply device 15, via the internal switch 12*a*, and the other end connected to the ground. The plus development power supply source 11 has one end connected to the development roller 4*a* and the constant-voltage power supply device 15, via the internal switch 12*b*, and the other end connected to the ground. In addition, the development blade 4*b* is connected to the toner supply roller 4*c* and the constant-voltage power supply device 15.

FIG. 2 shows a case of power polarity in which a normal charge for toner is set to a minus polarity. That is, in a potential pattern formed on the surface of the photoconductive member 1, a part of the potential pattern having a lower minus potential is a development region and a part of the potential pattern having a higher minus potential is a non-development region.

In FIG. 2, four regions relative to the photoconductive member 1 are indicated by letters A, B, C, and D. The region indicated by the letter A is referred to as a charging region A where the surface of the photoconductive member 1 is charged. The region indicated by the letter B is referred to as an exposure region B where the surface of the photoconductive member 1 is exposed to the laser light. The region indicated by the letter C is referred to as a development region C where the photoconductive member 1 and the development roller 4*a* make contact with each other. The region indicated by the letter D is referred to as a transfer region. To apply a bias having the minus polarity to the metal core of the development roller 4*a* at a time slightly before a lower minus potential region of the rotating surface of the photoconductive member 1 reaches the development region, the internal switches 12*a* and 12*b* are switched to activate the minus development power supply source 10. Thereby, the output voltage from the minus development power source 10 is applied to the metal core of the toner supply roller 4*c* and, via the constant-voltage power supply device 15, to the metal core of the development roller 4*a*.

For example, the following potentials are applied to each part of the above-described mechanism during the image forming process:

1) the non-exposed area (non-development area) of the surface of the photoconductive member 1 is applied with −750 volts;
2) the exposed area (development area) of the surface of the photoconductive member 1 is applied with −100 volts;
3) a bias to the development roller is −400 volts; and
4) biases to the toner supply roller and the development blade are −550 volts, wherein the difference of the bias voltage to the development roller and to the toner supply roller is 150 volts with the constant-voltage power supply device 15.

These voltage settings make the performance of the image development operation possible. For example, the voltage difference between the development roller 4*a* and the development region of the photoconductive member 1 is used to transfer the minus-charged-toner from the surface of the development roller 4*a* to the development region of the photoconductive member 1. Also, the voltage differences between the biases of the toner supply roller 4*c* and the development blade 4*b* and the bias of the development roller 4*a* are used to properly apply a charge to toner and to stably supply the charged toner to the surface of the development roller 4*a* such that the image development operation is properly performed.

When the photoconductive member 1 is driven by a motor (not shown) to start rotating, an area from the region A to the region C which is located downstream from the main charger 2 does not pass by the main charger 2 and passes by the development region without having the charge. In this case, the image development operation is performed because, in the contact type developing method, the image development operation is performed when the photoconductive member 1 has the surface charged at 0 volts and the metal core of the development roller 4*a* is set to the ground level. If the image development operation is performed under such a condition, the toner of the development roller 4*a* would be transferred onto the photoconductive member 1 at the full width of the development roller 4*a*. This would waste an extreme amount of toner, make the transfer roller 5*a* dirty, and causes a serious problem in the mechanism of the image forming apparatus 100. In order to avoid such a problem, the plus development power source 11 is activated to apply a plus voltage to the development roller 4*a* so that the toner is not transferred onto the photoconductive member 1 when the area of the photoconductive member 1 from the region A to the region C reaches the development region.

Figure 3:
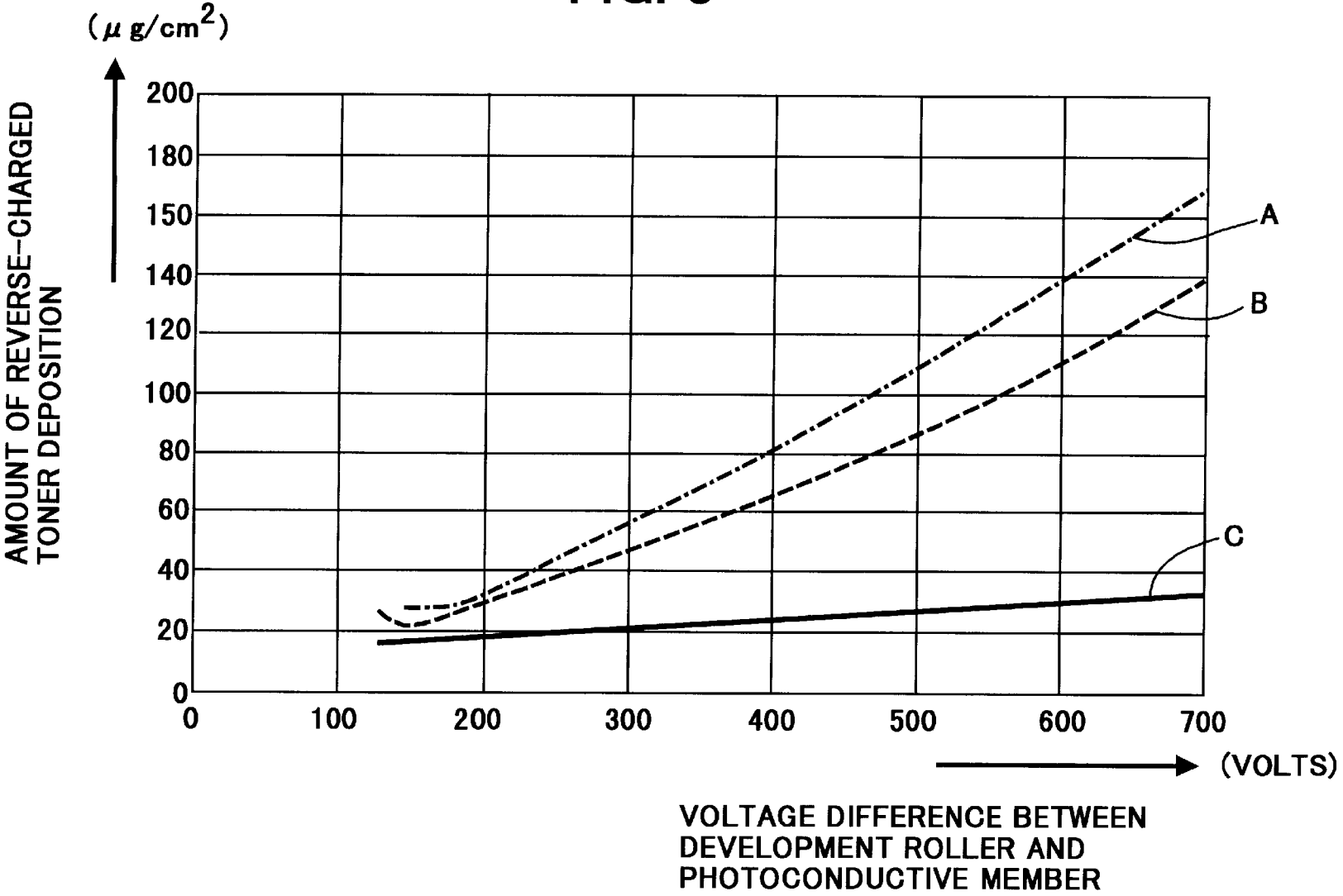
FIG. 3 is a graph showing a relationship between an amount of reverse-charged toner deposition and a voltage difference between a development roller voltage and a surface voltage of a photoconductive member used in the image forming apparatus of FIG. 1.

Referring to FIG. 3, the image development operation of the contact type image development method is explained in detail. FIG. 3 is a graph showing a relationship between an amount of the reverse-charged toner deposited on the photoconductive member and the voltage difference between the development roller and the surface of the photoconductive member. The vertical axis represents an amount of the reverse-charged toner deposition on the photoconductive member and the horizontal axis represents the difference of the voltage between the development roller and the surface of the photoconductive member. Lines indicated by letters A, B, and C represent cases using a contact type charging method over time, a non-contact type charging method over time, and a contact type charging method during an initial time period, respectively. As illustrated in FIG. 3, when the difference of the voltage between the development roller and the surface of the photoconductive member is small (close to 0), the amount of the reverse-charged toner deposited on the photoconductive member is lesser, but when the difference is great, the amount of reverse-charged toner deposition likely increases as a multi-dimensional curve.

Basically, the amount of reverse-charged toner deposition is desired to be 0, that is, a flat line is desired with the charge of the voltage difference in the graph of FIG. 3. However, in the contact type image development method, the amount of reverse-charged toner deposition likely increases as shown in FIG. 3. In a typical condition, the voltage difference will be between about 300 volts to about 400 volts depending upon the conditions of the photoconductive member 1 and the environmental conditions and the amount of the reverse-charged deposition will be about 30 $Fg/cm^2$, which will cause no problem. But, when the photoconductive member 1 is subjected to a relatively long time use, the amount of the reverse-charged deposition is increased. In addition to the graph of the contact type image development method, FIG. 3 also shows a graph of the non-contact type image development method. Both methods likely increase the amount of the reverse-charged toner deposition over time in comparison to those at an initial time. For example, at 400 volts of the horizontal axis, the contact type image development method marks 80 $Fg/cm^2$ and the non-contact type image development method marks 65 $Fg/cm^2$. These amount are enough to increase the dirtiness of the transfer roller 5*a* and to finally cause the above-mentioned problems. Therefore, a countermeasure is needed in this case.

Referring again to FIG. 2, the transfer roller 5*a* is explained in detail. The transfer unit 5 includes the transfer roller 5*a* that has a metal core surrounded by a roller-like-shaped semi-conductive foam and a resistance between the metal core and the roller surface is within the range of $10^5$ Ω and $10^9$ Ω. The semi-conductive foam of the transfer roller 5*a* is made of polyurethane, silicon, EPDM, polycarbonate, or the like.

In the operations of the transfer unit 5, the transfer roller 5*a* is held in contact with the photoconductive member 1 and is rotated in the direction to follow the rotation of the photoconductive member 1 and makes the recording sheet 5*e* enter into the gap between the photoconductive member 1 and the transfer roller 5*a*. Further, the metal core of the transfer roller 5*a* is applied with a relatively high voltage by the high power application unit 16 so that an electrical field is formed between the recording sheet 5*e* and the photoconductive member 1, and the toner deposited on the photoconductive member 1 is attracted onto the recording sheet 5*e* with the electric forces. When the normal charge polarity of the toner is minus, for example, the plus voltage from the high power application unit 16 is applied to the transfer roller 5*a*.

In the conventional image forming apparatus, the metal core of the transfer roller 5*a* is applied with a relatively high voltage by the high power application unit 16 during the time period when the recording sheet 5*e* passes through the transfer region D formed between the photoconductive member 1 and the transfer roller 5*a*. Other than this time period, the transfer roller 5*a* is mostly grounded, except for the time period in which the transfer roller 5*a* is applied with the voltage of the reverse-polarity so as to be subjected to the cleaning operation. However, when the photoconductive member 1 is in the charge region where the toner is reverse-charged and conveys the reverse-charged toner to the transfer region D, the toner is transferred onto to the transfer roller 5*a* due to the action of the mirror image force since the transfer roller 5*a* reduced the charge voltage of the photoconductive member 1 although the reverse-charged toner is normally not transferred because of the direction of the electric field generated by the charge voltage of the photoconductive member 1. In this example, the transfer of the reverse-charged toner to the transfer roller 5*a* is inhibited by causing the constant-voltage or constant-current power source to apply the voltage having the polarity same as that used during the regular transfer operation to the transfer roller 5*a* even under the above-mentioned circumstance.

That is, when the normal charge polarity of the toner is minus, the constant-voltage or constant-current power source is caused to apply a plus voltage to the transfer roller 5*a*. The power source for this countermeasure may be the one used in the transfer operation, or a separate power source. In addition, an output value from this power source that equals to the value of the actual transfer operation can be used, or an output value that may be less voltage but is capable of performing the operation can be used.

In one example from experiments, the problem of the reverse-charged toner transfer was inhibited by applying a +400 volts to the transfer roller 5*a* when the photoconductive member 1 was rotated at a line speed of 36 mm/s at the circumference and was charged with −750 volts. Although an appropriate value depends on the system conditions, it was found in the experiments that the applied voltage had an upper limit range of from +100 volts to +200 volts and was preferably set to a value within the range of from +200 volts to +800 volts so as to perform a better transfer operation without any side effect.

In another example from the experiments, the problem of the reverse-charged toner transfer was also inhibited by applying a constant current of +3 μA to the transfer roller 5*a* when the photoconductive member 1 was rotated at a line speed of 36 mm/s at the circumference and was charged with −750 volts. If the line speed of the photoconductive member 1 is increased, it is needed to apply a greater value of the constant current. Although an appropriate value depends on the system conditions, it was found in the experiments that the applied constant current had an upper limit range of from +0.5 μA to +20 μA and was preferably set to a value within the range of from +1 μA to +10 μA so as to perform a better transfer operation without any side effect.

In the image forming apparatus 100, there may be several cases for the transfer roller 5*a* to be applied with a voltage having the same polarity as that of the normal transfer operation at the following timing when the charged region of the photoconductive member 1 reaches the transfer region D without having the recording sheet 5*e*. In a first example, the reverse-polarity voltage can be applied to the transfer roller 5*a* when the photoconductive member 1 starts to rotate before starting the image forming operation. In a second example, the reverse-polarity voltage can be applied to the transfer roller 5*a* when the transfer roller 5*a* and the photoconductive member 1 make direct contact with each other in the gap between the recording sheets 5*e* for producing a plurality of outputs. In a third example, the reverse-polarity voltage can be applied to the transfer roller 5*a* when the transfer roller 5*a* and the photoconductive member 1 make direct contact with each other when the image forming operation is finished and before the rotation is finished.

Figure 4:
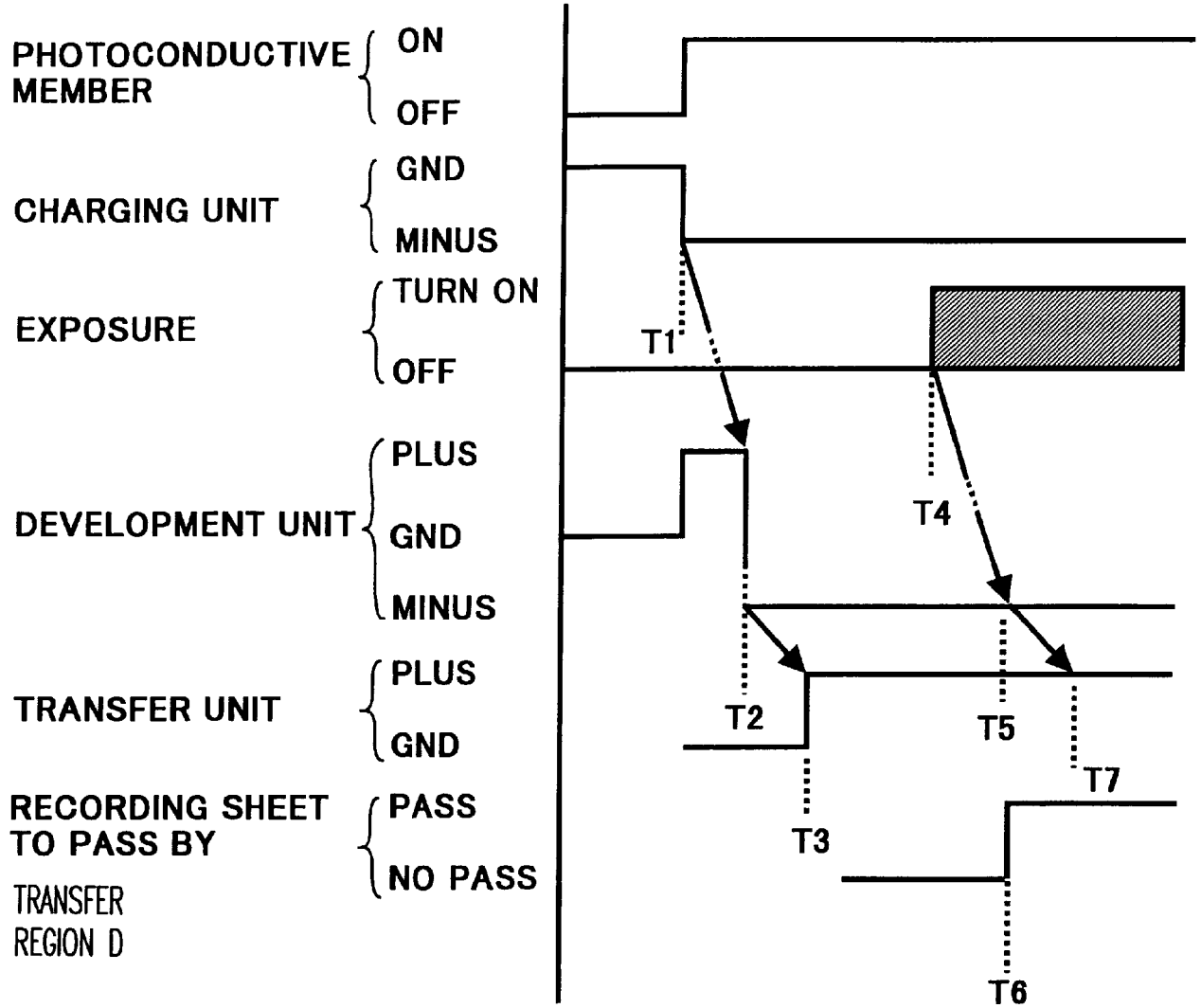
FIGS. 4–6 are time-charts of transfer roller cleaning operations performed by the image forming apparatus of FIG. 1.

Referring to FIG. 4, the above-mentioned first example of applying the reverse-polarity voltage to the transfer roller 5*a* is further explained. In FIG. 4, the main charger 2 starts to charge at T1 which represents a time when the photoconductive member 1 starts to rotate. A slight shift of this timing can be possible. In many cases, the photoconductive member 1 and the development roller 4*a* are driven by a common motor, and therefore the development roller 4*a* is needed to be applied with a plus voltage at the same time when it is started to be driven. The voltage applied to the development roller 4*a* is changed from the plus voltage to the minus voltage at a time T2 which represents a time when the leading edge of the charged region of the photoconductive member 1 reaches the development region C. After that, the transfer roller 5*a* which is grounded is applied with the plus voltage at a time T3 which represents a time when the leading edge of the charged region of the photoconductive member 1 reaches the transfer region D. At this time, the recording sheet 5*e* does not reach the transfer region D. Then, writing of an image pattern is started relative to the photoconductive member 1 at a time T4 and the development is started in accordance with the image pattern at a time T5 which represents a time when the leading edge of the exposed region reaches the development region C. The recording sheet 5*e* is transported such that the leading edge thereof reaches the transfer region D at a time T6 which is timed slightly before a time T7 which represents a time when the leading edge of the exposed region of the photoconductive member 1 reaches the transfer region D.

Therefore, the transfer roller 5*a* is caused to be applied with the reverse-polarity voltage relative to the normal charge to the toner during the time periods from T3 through to T6, that is, during the time when the charged region of the photoconductive member 1 and the transfer roller 5*a* make direct contact with each other without having the recording sheet 5*e*. Thereby, the transfer of the reverse-charged toner to the transfer roller 5*a* is inhibited.

Figure 5:
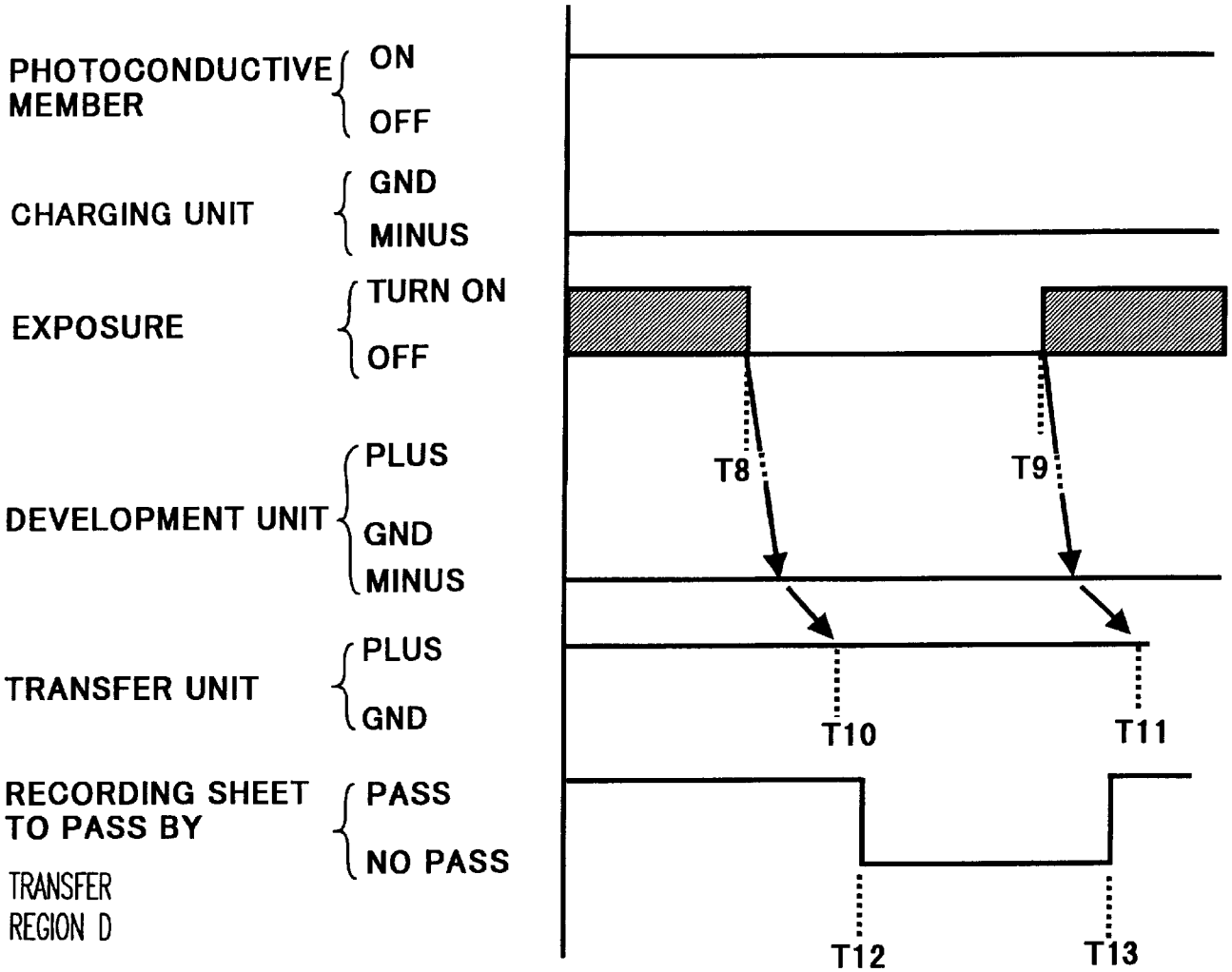

Referring to FIG. 5, the above-mentioned second example of applying the reverse-polarity voltage to the transfer roller 5*a* is further explained. During the image forming operation for a plurality of outputs, the photoconductive member 1 is continuously rotated even in the gap between the recording sheets and the main charger 2 performs the normal charging operation accordingly so as to continue to apply the minus voltage to the photoconductive member 1. As shown in FIG. 5, during the image pattern writing operation, the exposure of the previous image is stopped at T8 and, in a predetermined time period, the exposure of the next image is started at T9. The development roller 4*a* is applied with the minus voltage during the time of T8 and T9 so as to develop the previous and next images. The trailing edge of the previous image reaches the transfer region D at T10 and the trailing edge of the recording sheet 5*e* reaches at T12 which is arranged slightly after T10. The leading edge of the next image reaches the transfer region D at T11 and the leading edge of the recording sheet 5*e* reaches the transfer region D at T13 which is arranged to be slightly after T11.

Therefore, the transfer roller 5*a* is caused to be applied with the reverse-polarity voltage relative to the normal charge to the toner during the time periods from T12 through to T13, that is, during the time when the charged region of the photoconductive member 1 and the transfer roller 5*a* make direct contact with each other without having the recording sheet 5*e*. Thereby, the transfer of the reverse-charged toner to the transfer roller 5*a* is inhibited.

Figure 6:
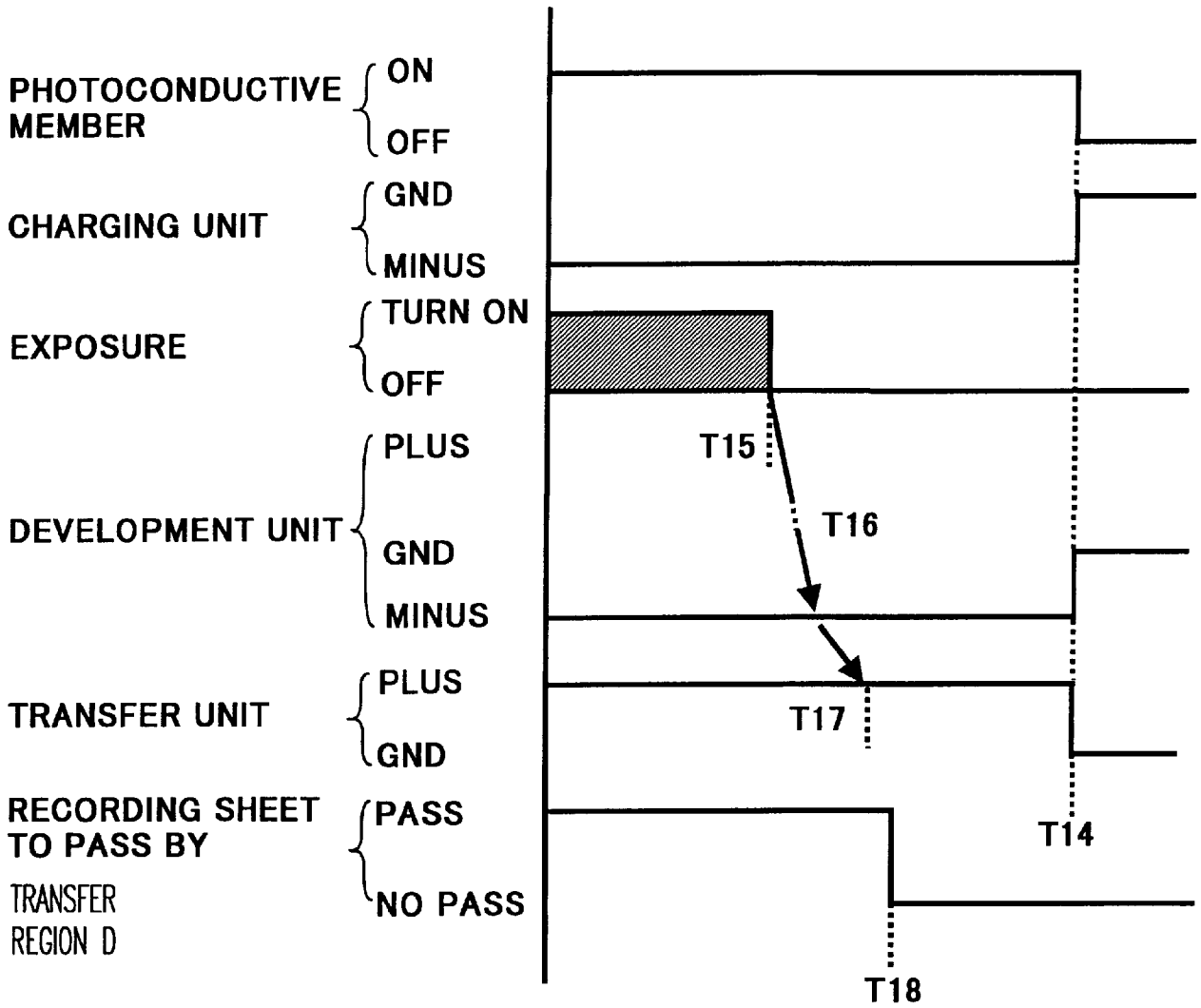

Referring to FIG. 6, the above-mentioned third example of applying the reverse-polarity voltage to the transfer roller 5*a* is further explained. As shown in FIG. 6, during the image pattern writing operation, the exposure of the image is completed by T15 and the trailing edge of the written image reaches the development region C at T16 and the transfer region D at T17. In a predetermined time after T17, the trailing edge of the recording sheet 5*e* reaches the transfer region D at T18. During these operations, the photoconductive member 1 is kept driven for rotation and being charged until it is stopped to be driven at T14. Accordingly, the minus voltage for the development is kept applied, and therefore the transfer roller 5*a* is applied with the plus voltage by T14.

Therefore, the transfer roller 5*a* is caused to be applied with the reverse-polarity voltage relative to the normal charge to the toner during the time periods from T18 to T14, that is, during the time when the charged region of the photoconductive member 1 and the transfer roller 5*a* make direct contact with each other without having the recording sheet 5*e*. Thereby, the transfer of the reverse-charged toner to the transfer roller 5*a* is inhibited.

Although each of the above-mentioned examples applies the same polarity voltage as that used in the transfer operation to all the areas of the charged area of the photoconductive member 1, it is possible to limit the area to apply the voltage due to some reason (i.e., a structural reason). However, it is preferable to apply the voltage relative to the area over 50% of all the areas of the charged area of the photoconductive member 1.

In the image forming apparatus 100, the main charger 2 uses the corona discharging method, as described above. As an alternative to that, a contact type charging method using a charge roller or a charge brush may be employed, which reduces an output amount of ozone, NOx, and so on. Such a charging unit producing less toxic gases is welcomed by the market since the use of the image forming apparatuses such as printers, facsimile machines, and so forth is expanded from offices to home with the recent trend for the reduction of the toxic gases such as ozone, NOx and so on.

Figure 7:
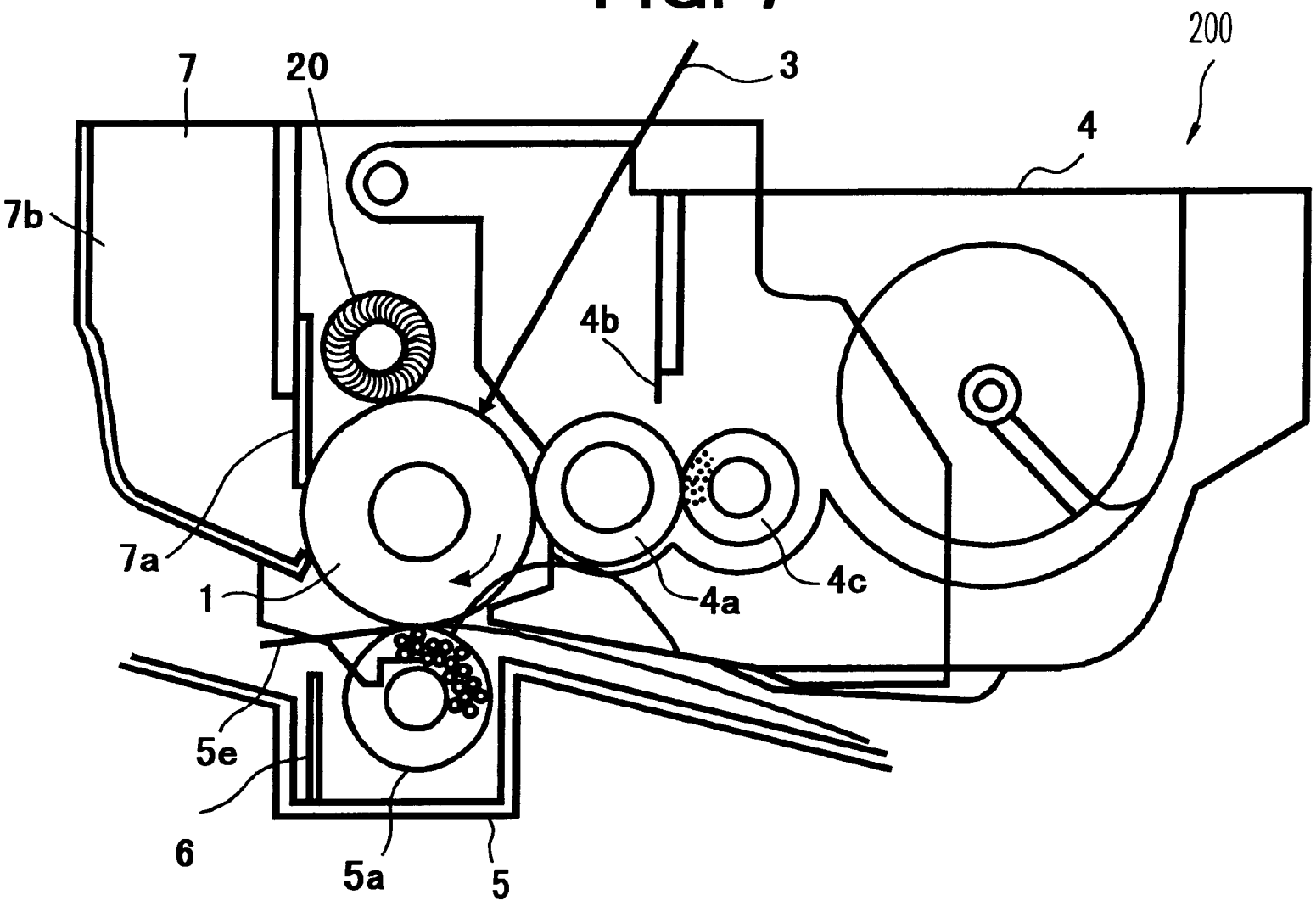
FIG. 7 is a side sectional view of an image forming apparatus according to a second embodiment of the present invention.

Next, an image forming apparatus 200 according to a second embodiment of the present invention is explained with reference to FIG. 7. FIG. 7 shows an image forming apparatus 200 which is similar to the image forming apparatus 100 of FIG. 1, except for a brush roller main charger 20. The brush roller main charger 20 includes a conductive base cloth on which conductive fibers (i.e., carbon fibers) are implanted and which wraps around a metal core, having the conductive fibers cut in an even length from the center of the metal core. Such a brush roller main charger 20 is configured to make contact in pressure with the photoconductive member 1 and to rotate at a line speed which is different from the line speed of the photoconductive member 1. The brush roller main charger 20 may rotate counterclockwise or clockwise in the drawing.

The brush roller main charger 20 is applied at its metal core with a voltage of from 1000 volts to −1500 volts, for example, in accordance with the charge polarity of the photoconductive member 1 so as to discharge. In the image forming apparatus 100 using the non-contact type charging method, a voltage of from −3000 volts to −7000 volts is applied. The difference of the voltages and the flowing currents between the two apparatuses cause the difference of production amount of the toxic gases. The reason why the contact type charging method can reduce the production of the toxic gases is this.

The brush roller main charger 20 discharges in a relatively small area close to a point where the brush roller main charger 20 makes contact with the photoconductive member 1 and the discharged charge remains around the surface of the photoconductive member 1, thereby charging the photoconductive member 1. Each fiber of the brush roller main charger 20 serves as a discharging electrode. A charge discharged from the fiber goes straight to the surface of the photoconductive member 1 by the action of the electric field and since the distance to the photoconductive member 1 is close the charge is prone to be gathered. Accordingly, the surface of the photoconductive member 1 can evenly be charged.

As described above, a greater amount of the reverse-charged toner deposition is caused with the contact type charging method. However, the reverse-charged toner deposition can be avoided by employing the control described above with reference to FIGS. 4 to 6. That is, when the area of the photoconductive member 1 charged by the brush roller main charger 20 reaches the transfer region D without having a recording sheet 5*e*, the transfer roller 5*a* is applied with a voltage having a same polarity as that used in the transfer operation. Thereby, the image forming apparatus 200 can inhibit the transfer of the reverse-charged toner to the transfer roller 5*a*. Since a series of the image forming operation of the image forming apparatus 200 is similar to that of the image forming apparatus 100, and therefore the description thereof is omitted.

As an alternative to the brush roller main charger 20, the image forming apparatus 200 can employ another type of contact charger such as a charge roller including a metal core wrapped with a solid rubber roller, a charge brush bar including a metal plate implanting fibers, or the like. In the case of solid type charge roller, it may be rotated following the rotation of the photoconductive member 1 at the same line speed.

In the control sequence of the image forming apparatus 200 shown in FIG. 7, the photoconductive member 1 is charged slightly before stopping and, during the transfer operation, is applied with a voltage having a same polarity as that used in the normal transfer operation. Thereby, the photoconductive member 1 is normally charged during the time period between the charge and transfer operations. Further, the photoconductive member 1 may stop as being charged under the reverse-charged condition depending upon the conditions of usage or as being charged with the normal charging operation. If the photoconductive member 1 is left for a relatively long time under such a condition, the photoconductive member 1 may have a deterioration due to the electrostatics.

Figure 8:
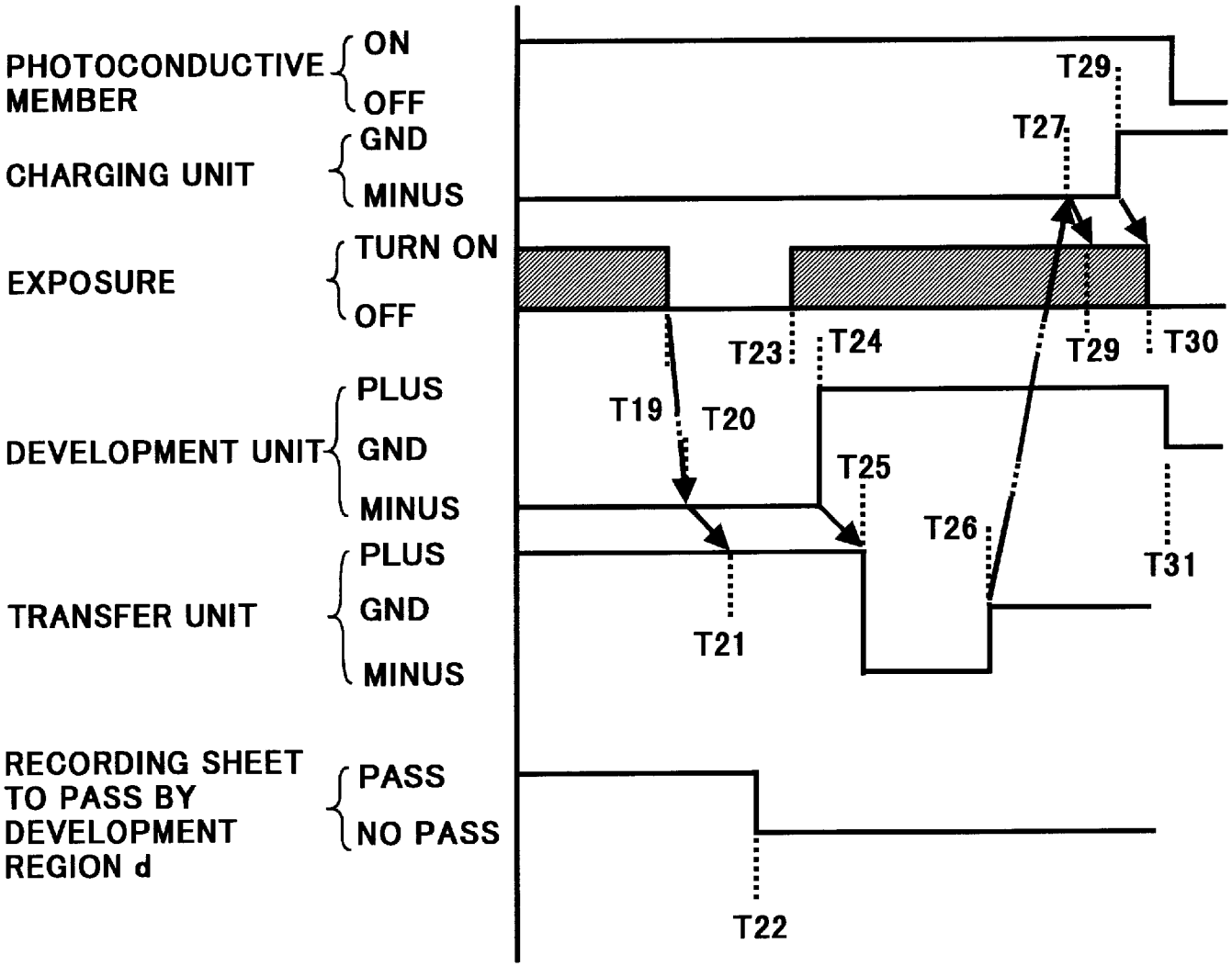
FIG. 8 is a time-chart of a transfer roller cleaning operation performed by the image forming apparatus of FIG. 7.

Referring to FIG. 8., a countermeasure for the above-mentioned deterioration problem due to the electrostatics is explained. FIG. 7 shows a modified sequence of the image forming operation performed by the image forming apparatus 200. In FIG. 8, the trailing edge of the image pattern passes by the exposure region B of the photoconductive member 1 at T19 and, if the trailing edge of the image pattern reaches the development region C at T20 and the transfer region D at T21, the trailing edge of the recording sheet 5*e* is caused to pass by the transfer region D at T22 slightly after T21. The exposure operation restarts at T23 and exposes the entire surface of the photoconductive member 1 by T29, thereby reducing the surface voltage of the photoconductive member 1. The metal core of the development roller 4*a* is applied with a plus voltage having a reverse-polarity relative to the polarity of the voltage used during the normal development operation from T24 which is a time when the region of the surface of the photoconductive member 1 located at the exposure region B at T23 reaches the development region C. This is to protect the surface of the photoconductive member 1, having a charge reduced due to the light exposure, from being deposited by the toner having a normal charge which causes the development. When the surface voltage of the photoconductive member 1 is controlled to be within the range from "0 volts to −50 volts, it will be sufficient to apply about +200 volts to the development roller 4*a* so as to inhibit the transfer of the reverse-charged toner to the photoconductive member 1.

Under this condition, the metal core of the transfer roller 5*a* is applied with the minus voltage having the same polarity as that of the toner charge from T25 which is a time when the region of the surface of the photoconductive member 1 located at the exposure region B at T23 reaches the transfer region D. As a result, since the toner is prone to be charged to the minus voltage, the toner deposited on the transfer roller 5*a* is charged to the minus voltage and is transferred back to the surface of the photoconductive member 1 by the action of the electric field formed by the voltage applied to the transfer roller 5*a*. Thereby, the surface of the transfer roller 5*a* is cleaned off.

In this example, the cleaning of the transfer roller 5*a* is performed during the time period from T25 to T26. It is generally preferable to set this time period from T25 to T26 to a value greater than a time needed for one rotation of the transfer roller. During this time period from T25 to T26, the transfer roller 5*a* is applied with about −300 volts, the photoconductive member 1 is kept driven and is kept applied with the minus voltage, the exposure operation is performed relative to the entire surface of the photoconductive member 1, and the development roller 4*a* is kept applied with the plus voltage so as to protect the deposition of the reverse-charged toner.

The application of the minus voltage to the transfer roller 5*a* is stopped at T26 and, after that, the transfer roller 5*a* is grounded. When the region of the surface of the photoconductive member 1 located at the transfer region D at T26 returns to the charging region A at T27 via the cleaning unit 7, the charging operation is still kept on and the surface of the photoconductive member 1 is again minus-charged by the main charger 2. This process clears off the entire surface of the photoconductive member 1 which may have a plus-charged region from the plus-charged transfer roller 5*a*. After that, the charging operation of the main charger 2 is stopped at T29 and the charged region of the surface of the photoconductive member 1 is exposed for a time period by T30. Thereby, the photoconductive member 1 is protected from being left as minus-charged. To make the above-described operations possible, the time period from T23 through to T30 is set to a value enough for the photoconductive member 1 to move for one rotation or more.

In the example being explained, the total sum of the time periods of (T24–T23), (T25–T24), (T27–T26), and (T28–T27) is equivalent to the time for one rotation of the photoconductive member 1. In addition, extra performance of the charging and exposure operations are conducted during the time periods of (T26–T25) and (T30–T28). After that, when the trailing edge of the exposed region counted at T30 reaches the development region C, the driving operation of the photoconductive member 1 and the application of the reverse voltage to the development roller 4*a* are stopped, thereby completing the image forming operation.

By the configuration as mentioned above, the photoconductive member is protected from the deposition of the reverse-charged toner by controlling the surface voltage of the photoconductive member so that a minus voltage having a same polarity as that of toner charge can be applied to the transfer roller and, at the same time, the transfer roller is also protected from the deposition of the reverse-charged toner. Further, under such a condition, the performance of the transfer roller can be maintained by performing the cleaning operation in which the toner is returned from the transfer roller back to the photoconductive member. Further, the surface voltage of the photoconductive member is reduced down to the ground level so as not to be left for a relatively long time period under the condition as being charged with a plus or minus voltage. Thereby, the photoconductive member can have a relatively longer life time.

Numerous additional modifications and variations of the present application are possible in light of the above teachings. It is therefore to be understood that within the scope of the appended claims, the present application may be practiced otherwise than as specifically described herein.

What is claimed is:

1. An image forming apparatus, comprising:

a photoconductive member;

a charging member configured to charge a surface of said photoconductive member;

a development mechanism configured to contact said photoconductive member to transfer toner thereto so as to develop an image on said surface of said photoconductive member, said toner in a normal charged condition having a same polarity as a polarity of a charge of said photoconductive member;

a transfer mechanism comprising a transfer roller configured to contact said photoconductive member so as to transfer said image developed by said development mechanism from said photoconductive member onto a recording sheet; and a power supply source configured to supply a first voltage to said transfer roller when a region of said surface of said photoconductive member charged by said charging member passes through a development region at which said photoconductive member and said development mechanism contact each other without having a development operation performed by said development mechanism, and reaches a transfer region at which said photoconductive member and said transfer roller contact each other under a condition in which no recording sheet exists therebetween, said first voltage having a same polarity as a polarity of a second voltage applied to said transfer roller during a normal transfer operation, wherein said photoconductive member is exposed to light for a time period in which said photoconductive member moves one rotation or more to reduce a voltage of an entire surface thereof after said photoconductive member is charged by said charging member but before an image is output and an image forming operation is ended, wherein said development mechanism is applied with a voltage having a reverse-polarity relative to a voltage applied to said development mechanism during a normal development operation when a region of said surface of said photoconductive member having said reduced voltage reaches said development region, wherein said power supply source is caused to apply to said transfer roller for a predetermined time period a voltage having a same polarity relative to a voltage applied to said toner during said normal development operation when said region of said surface of said photoconductive member having said reduced voltage reaches said transfer region, and wherein said transfer roller is grounded for a predetermined time period.

2. The image forming apparatus as defined in claim 1, wherein said power supply source is one of a constant-voltage power supply source and a constant-current power supply source.

3. The image forming apparatus as defined in claim 1, wherein said first voltage equals said second voltage.

4. The image forming apparatus as defined in claim 1, wherein said charging member comprises a contact member configured to contact said photoconductive member so as to charge said surface of said photoconductive member.

5. An image forming apparatus, comprising:

photoconductive member means;

charging means for charging a surface of said photoconductive member means;

developing means, configured to contact said photoconductive member means to transfer toner thereto, for developing an image on said surface of said photoconductive member means, said toner in a normal charged condition having a same polarity as a polarity of a charge of said photoconductive member means;

transferring means for transferring said image developed by said developing means from said photoconductive member means onto a recording sheet; and power supply means for supplying a first voltage to said transferring means when a region of said surface of said photoconductive member means charged by said charging means passes through a development region at which said photoconductive member means and said developing means contact each other without having a development operation performed by said developing means, and reaches a transfer region at which said photoconductive member means and said transferring means contact each other under a condition in which no recording sheet exists therebetween, said first voltage having a same polarity as a polarity of a second voltage applied to said transferring means during a normal transfer operation, wherein said photoconductive member means is exposed to light for a time period in which said photoconductive member means moves one rotation or more to reduce a voltage of an entire surface thereof after said photoconductive member means is charged by said charging means but before an image is output and an image forming operation is ended, wherein said developing means is applied with a voltage having a reverse-polarity relative to a voltage applied to said developing means during a normal development operation when a region of said surface of said photoconductive member means having said reduced voltage reaches said development region, wherein said power supply means is caused to apply to said transfer roller means for a predetermined time period a voltage having a same polarity relative to a voltage applied to said toner during said normal development operation when said region of said surface of said photoconductive member means having said reduced voltage reaches said transfer region, and wherein said transferring means is grounded for a predetermined time period.

6. The image forming apparatus as defined in claim 5, wherein said power supply means is one of a constant-voltage power supply source and a constant-current power supply source.

7. The image forming apparatus as defined in claim 5, wherein said first voltage equals said second voltage.

8. The image forming apparatus as defined in claim 5, wherein said charging means comprises contacting means for making contact with said photoconductive member means to charge said surface of said photoconductive member means.

9. The image forming apparatus as defined in claim 5, wherein said transferring means comprises a transfer roller for contacting the photoconductive member means so as to transfer the image.

10. A method of image forming, comprising the steps of:

charging a surface of a photoconductive member;

exposing said surface of said photoconductive member in accordance with image information;

first causing a development roller to develop an image on said surface of said photoconductive member using toner which is in a normal charged condition having a same polarity as a polarity of a charge applied to said photoconductive member;

second causing a transfer roller to transfer said image developed by said developing step from said photoconductive member onto a recording sheet with an application of a first voltage from a power supply source;

third causing said power supply source to supply a second voltage to said transfer roller when a region of said surface of said photoconductive member charged by said charging step passes through a development region without having a development operation performed by said developing step, and reaches a transfer region under a condition in which no recording sheet exists in said transfer region, said second voltage having a same polarity as a polarity of said first voltage, wherein said exposing step exposes said surface of said photoconductive member to light for a time period in which said photoconductive member moves one rotation or more to reduce a voltage of an entire surface thereof after said photoconductive member is charged by said charging step but before an image is output and an image forming operation is ended, wherein said developing step includes the step of applying to said development roller a voltage having a reverse-polarity relative to a voltage applied to said development roller during a normal development operation when a region of said surface of said photoconductive member having said reduced voltage reaches said development region, wherein said third causing step applies to said transfer roller for a predetermined time period a voltage having a same-polarity relative to a voltage applied to said toner during said normal development operation when said region of said surface of said photoconductive member having said reduced voltage reaches said transfer region, and wherein said transfer roller is grounded for a predetermined time period.

11. The method as defined in claim 10, wherein said power supply source is one of a constant-voltage power supply source and a constant-current power supply source.

12. The method as defined in claim 10, wherein said first voltage equals said second voltage.

13. The method as defined in claim 10, wherein said charging step comprises a step of making a charging member contact said photoconductive member to charge said surface of said photoconductive member.

* * * * *